US011428018B2

(12) United States Patent
Jasmin

(10) Patent No.: US 11,428,018 B2
(45) Date of Patent: Aug. 30, 2022

(54) LIGHT ENHANCING AND FLOOD PROTECTION WINDOW WELL INSTALLATION

(71) Applicant: Neville Joel Jasmin, Scarborough (CA)

(72) Inventor: Neville Joel Jasmin, Scarborough (CA)

( * ) Notice: Subject to any disclaimer, the term of this patent is extended or adjusted under 35 U.S.C. 154(b) by 0 days.

(21) Appl. No.: 17/039,192

(22) Filed: Sep. 30, 2020

(65) Prior Publication Data

US 2021/0102388 A1 Apr. 8, 2021

Related U.S. Application Data

(60) Provisional application No. 62/909,466, filed on Oct. 2, 2019.

(51) Int. Cl.

| | |
|---|---|
| ***E04F 17/06*** | (2006.01) |
| ***E04B 1/66*** | (2006.01) |
| ***E04H 9/14*** | (2006.01) |
| ***F21V 7/00*** | (2006.01) |
| ***F21S 11/00*** | (2006.01) |
| ***G08B 21/18*** | (2006.01) |
| ***F21Y 115/10*** | (2016.01) |

(52) U.S. Cl.

CPC ..... *E04F 17/06* (2013.01); *E04B 1/665* (2013.01); *E04H 9/145* (2013.01); *F21S 11/007* (2013.01); *F21V 7/0033* (2013.01); *F21Y 2115/10* (2016.08); *G08B 21/18* (2013.01)

(58) Field of Classification Search

CPC ..... E04F 17/06; F21S 11/007; F21S 19/005; F21S 9/03; E04B 1/665; E04H 9/145; F21V 7/0033; F21V 7/0008; F21V 23/0442; F21V 33/006; G08B 21/18; G08B 21/20; F21Y 2115/10

See application file for complete search history.

(56) References Cited

U.S. PATENT DOCUMENTS

| | | | | |
|---|---|---|---|---|
| 1,840,397 | A * | 1/1932 | Keyes | E04F 17/06 52/107 |
| 3,703,791 | A | 11/1972 | Slade | |
| 3,844,076 | A | 10/1974 | Schock | |
| 4,903,455 | A * | 2/1990 | Veazey | E04B 1/0046 52/73 |
| 4,921,339 | A | 5/1990 | Brischke | |
| 5,027,566 | A | 7/1991 | Golowski | |
| 5,655,339 | A * | 8/1997 | DeBlock | E04D 13/03 52/200 |
| 5,703,720 | A | 12/1997 | Fulco et al. | |
| 6,502,950 | B2 * | 1/2003 | Signer | F21S 11/00 362/147 |
| D669,598 | S * | 10/2012 | Timchak | D25/47.1 |

(Continued)

FOREIGN PATENT DOCUMENTS

| | | | |
|---|---|---|---|
| CN | 202165988 | U | 3/2012 |
| EP | 2662621 | A2 | 11/2013 |

*Primary Examiner* — Peggy A Neils

(74) *Attorney, Agent, or Firm* — Stratford Group Ltd.

(57) ABSTRACT

The present disclosure relates to a resilient and multipurpose window well installation. The installation comprises numerous different features and optional additional attachments and functionalities. In one embodiment, the installation can increase the amount of light entering into a basement window. In an alternative embodiment, the installation can also protect from influx of flood water through the basement window.

18 Claims, 16 Drawing Sheets

(56) References Cited

U.S. PATENT DOCUMENTS

| | | | | |
|---|---|---|---|---|
| 8,557,109 | B1 * | 10/2013 | Sutherland | E03F 5/0409 210/163 |
| 8,690,359 | B1 | 4/2014 | Clock | |
| 9,192,243 | B2 * | 11/2015 | Slaughter | E06B 9/24 |
| 9,605,438 | B1 | 3/2017 | Bramble et al. | |
| 10,184,629 | B2 | 1/2019 | Davis | |
| 11,030,871 | B2 * | 6/2021 | Wedig | G06K 9/6296 |
| 2014/0003038 | A1 * | 1/2014 | Kim | F21V 33/006 362/145 |
| 2015/0107170 | A1 * | 4/2015 | Olkin | E06B 1/56 52/202 |

* cited by examiner

LIGHT ENHANCING AND FLOOD PROTECTION WINDOW WELL INSTALLATION

CROSS-REFERENCE TO RELATED APPLICATIONS

This application claims priority to U.S. Provisional Application No. 62/909,466, filed Oct. 2, 2019, which is hereby incorporated by reference herein in its entirety.

FIELD OF THE INVENTION

The present disclosure relates to improvements to window well installations, particularly to means of rendering window wells to be flood resistant and more particularly to additions to window wells that increase the amount of natural light entering into the basement.

BACKGROUND

A home that has a basement, with the basement having one or more windows, typically has a window well associated with each window. The window well is a subterranean opening that allows for sunlight to enter into the basement through the basement window. However, during winter, inclement weather conditions such as snow and rain may pool in the window well. This can cause deterioration and damage to the window. During these conditions, the elements may also enter into the basement, causing damage therein.

In known prior art, a window well cover has typically been used to protect the window well and the associated window from the elements. Prior art window well covers are typically made from a plastic material and covers the window well opening while resting against the adjacent exterior wall of the building. One disadvantage with known window well covers is that they reduce the amount of sunlight that can enter into the window. Further, the prior art window well covers are typically made from material that is not durable, which leads to cracks, and the ultimate structural failure, in the cover. Numerous known window well covers are made from poor quality materials that usually last only one winter.

U.S. Pat. No. 8,690,359 discloses a window well projection system having a periscope-type mechanism comprising a pair of mirrors which mount within a window well area. An upper portion of the system comprises a mirror which reflects light and scenery downward. A bottom portion of the system comprises a second minor which projects said light and scenery through a below-grade window portion of a building. A protective transparent plastic cover maintains a watertight construction. The system comprises a first mirror, a second mirror, and a viewing pane. The first mirror is located above an upper edge portion of a well assembly portion of the system and enables receipt of ambient daylight and a view of outdoor scenery via a first reflection. The first reflection is then deflected downwardly onto a second mirror located within the well assembly to produce a second reflection. The second mirror in turn deflects the second reflection onto a viewing pane, thus providing the basement within the building structure with daylight which passes through said viewing pane and an existing below-grade window, if so configured.

U.S. Ser. No. 10/184,629 discloses a window illumination enhancer having at least one planar reflective surface and two openings is designed to fit in a window well of a building. The surface reflects light from a first of the openings through the window, via the second opening. The first opening is located above the window well. A polymer film surrounds the path of the light between the two openings to reduce soiling of at least the surface. A second planar reflective surface may be included and may be arranged to form a periscopic device, which affords an above-ground view of the exterior. A kit is provided for assembly to form a planar reflective illumination device, the kit including: a first planar reflective surface; a collection of members interconnectable to define a structure for supporting the first surface; and a polymeric film for surrounding at least a part of the structure where: the structure provides first and second optical paths extending from the first surface to first and second entrances respectively, without obstruction by any part of the device, an angle of projection onto the first surface of a view from the first entrance via the first path is reflected onto the second path to exit the device at the second entrance.

U.S. Pat. No. 5,703,720 discloses a light collection and distribution apparatus for use with an exterior window well comprising a window well liner having at least one primary surface which is reflective and faces the window to reflect light rays in the direction of the window, a reflective panel mounted on the building wall above the window, and other mechanisms for increasing light passage through the building wall including a transom disposed in the building wall above the window, reflective surfaces disposed on the bottom sill of the window and on the side jamb. The light collection and distribution apparatus for use with an exterior window well that comprises a window well liner having a number of original reflective surfaces and other means for increasing light passage through the building wall which are designed to increase the amount of light rays passing through the below grade window and into the basement space.

U.S. Pat. No. 4,921,339 discloses a dual mirror viewing system for providing an above ground exterior view through a below ground basement window surrounded by an exterior well, includes a pair of elongated extensible spaced frame members. A pair of elongated mirrors are mounted in inclined orientation at axially spaced locations between the frame members. Each of the mirrors is mounted by a bracket for axial, lateral, and angular adjustments. An upper one of the mirrors may have a convex surface for providing a wide-angle view to basement occupants. in addition to providing a scenic view, the dual mirror system may be utilized to provide a light source to a basement room. Depending upon the orientation of the basement window pane, the mirrors may be adjusted to afford a maximum amount of natural light during a selected time period of the day. Additionally, the mirrors may be seasonally adjusted to maintain an optimal degree of illumination. A transparent cover including a peripheral flange adapted for mounting over the peripheral rim of a conventional window well. The cover includes a mounting tab for securement to the exterior wall of a building. The cover prevents the mirrors from being soiled by dust or rain.

EP2662621 discloses a device for illuminating interior spaces. The device has wall opening that is surrounded by the housing in which light shaft of light-conducting and light-reflecting elements are installed. The wall opening of the interior space is illuminated by light shaft according to installation of exit conductors in the housing. A device is used for illumination of the interior in particular daylight from the outside with a wall opening enclosing housing and a built-in light shaft, the upper end is approximately flush with the ground level and the lower end opens in the wall opening wherein the cross section of the light shaft in terms of area is dimensioned there about as large as that of the wall opening. The housing made of brick or concrete masonry is disposed directly on the outer wall of the building. Its upper end is open and has a transparent cover which is hinged as needed. Its lower end is also open and allows so that eventually can seep water seepage into the ground. The light shaft is made of light-conducting and light reflecting elements, which are made as a mirror modules of mirror glass or a comparable material.

CN202165988 discloses a mirror surface light well which structurally comprises a light amplifier, a daylight opening, a ventilation device, a wasp excluder, a separating barrier, a bracket, a rectangular light guiding bent pipe, a water discharging pipe, a gully drain and a lighting window, wherein the front side surface of the daylight opening is provided with the light amplifier, the inner walls of the rectangular light guiding bent pipe are efficient retroreflector inner walls, the periphery of the daylight opening is provided with the ventilation device, the wasp excluder, the separating barrier, and the water discharging pipe which are arranged outside a room which is arranged on a building outer wall ground and faces to the sun, the lighting window is arranged in a room of side surface walls of a basement, the rectangular light guiding bent pipe is connected between the daylight opening and the lighting window, and the bending slope of the rectangular light guiding bent pipe can be determined according to that a reflected light path is lighted on the ground of the basement or the top surface of the basement by the lighting window the mirror surface light well. The mirror surface light well has the effects of lighting, ventilating and water discharging, and can directly lead outdoor natural light into the basement so as to enable the basement to have sunshine, air and attractive sceneries.

U.S. Pat. No. 3,844,076 discloses a basement window shield comprising a prefabricated shield of thin wall construction adapted for attachment to a building wall at a level below grade in front of an aperture such as a basement window for admitting air and light thereto. The shield can be made of concrete, plastic or metal and has curvature in three dimensions so as to be subject substantially only to compressive forces. The shield has an open upper end on which a cover can optionally be placed, and it has a rear opening adapted to overlap the building wall aperture. This configuration provides the advantage that light falling into the basement window is amplified by reflection from the inclined wall.

U.S. Pat. No. 5,027,566 discloses a window well reflective enclosure containing a double-pane bay window panels, with movable inserts between the panes, which function as shading devices, and light reflective panels directly extending above the bay window panels at top portion, intended to channel the sunlight and an outside view from the translucent roof membrane to the exterior wall installed transparent mirror window. This enclosure, in the form of a bay shaft configuration adapted for positioning around such window, is attached at the upper end around the translucent roof membrane and at the bottom and terminated below the wall window.

U.S. Pat. No. 9,605,438 discloses an externally protruding light-capture window well. The window well assembly for providing natural light to an interior of a dwelling comprising a light-refracting block, a flange, an outer gasket, an internal gasket, a reinforcing band, and a fastener. The window well assembly is installed into a wall in the dwelling where the light-refracting block externally protrudes from the wall for natural light refraction into the interior of the dwelling. The light-refracting block comprises a block body that presents an external receiving side, an external transmitting side, an upper wall-interfacing side, a lower wall-interfacing side, and an internal emergent side. Natural light enters the external receiving side or external transmitting side and refracts through the block body until emitted through the internal emergent side.

U.S. Pat. No. 3,703,791 discloses a window well cover of the type having a light-transmitting sheet selectively sized to cover an open top of a window well is characterized by an elongated, reinforcing, metal strip extending parallel to, and disposed near, a foundation wall. The metal strip has a horizontal portion formed with an elongated slot receiving and firmly supporting the adjoining sheet edge, which is tightly clamped in the slot. An upstanding portion of the rigidifying strip enhances the vertical rigidity of the window well cover and forms a base for supporting an upstanding sheet of light-transmitting material which serves as a storm window for that portion of a basement window projecting above the window well.

All documents cited are herein incorporated by reference.

None of the above cited documents, alone or in combination satisfy the need for a resilient and multipurpose window well installation. There therefore remains a need for a window well installation that can increase the amount of light entering into a basement window, and also protecting from influx of flood water. Accordingly, there is a need for window well cover that takes resolves the above-mentioned disadvantages.

BRIEF SUMMARY

It is an object of the invention to provide a light enhancing and flood protection window well installation.

In accordance with an aspect of the invention there is provided a kit for enhancing light entry into a basement window of a building, said basement window having a pre-installed window well defining a window well cavity, said kit comprising: a supporting structure sized and proportioned to fit within said window well cavity; a first reflective surface adapted to be affixed to an exterior wall of said building above said window; and a second reflective surface adapted to be affixed to said supporting structure.

In accordance with another aspect of the invention there is provided an apparatus for protecting a basement window of a building from flooding, said basement window having a pre-installed window well defining a window well cavity, said apparatus comprising: one or more flood protection devices configured to be affixed to said window well or any other supporting structure installed within said window well; one or more water detection sensors that, when activated, sends a signal to a mobile device, application or alarm system; and a power source operationally engaged with said sensor.

In accordance with yet another aspect of the invention there is provided a method of enhancing light entry into a basement window of a building, said basement window having a pre-installed window well defining a window well cavity, said method comprising the steps of: affixing one or more first light reflective surfaces onto a side wall of said building above said window; installing one or more second light reflective surfaces within said window well; and adjusting the positioning of said one or more first and second light reflective surfaces such that they are at appropriate angles to direct light incident from said one or more first light reflective surfaces onto said one or more second light reflective surfaces and through said window.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The present invention advantageously fills the aforementioned deficiencies in the known prior art. The present invention is superior to other window well covers in that it provides for a durable window well cover apparatus that includes light reflective panels and flood prevention functionality.

In one aspect of the present invention, a window well cover having a plurality of reflective panels is disclosed. The reflective panels allow for a greater amount of sunlight to enter through the window and into the basement than the prior art window well covers. Additionally, in this aspect, the window well cover apparatus is constructed from durable material that reduces the risk of cracking or damage.

The features of the invention which are believed to be novel are particularly pointed out in the specification. The present invention now will be described more fully hereinafter with reference to the accompanying drawings, which are intended to be read in conjunction with both the summary, the detailed description and any specific and/or particular embodiments discussed or otherwise disclosed. This invention may, however, be embodied in many different forms and should not be construed as limited to the embodiments set forth herein; rather, these embodiments are provided by way of illustration only and will convey the full scope of the invention to those skilled in the art.

Figure 1:
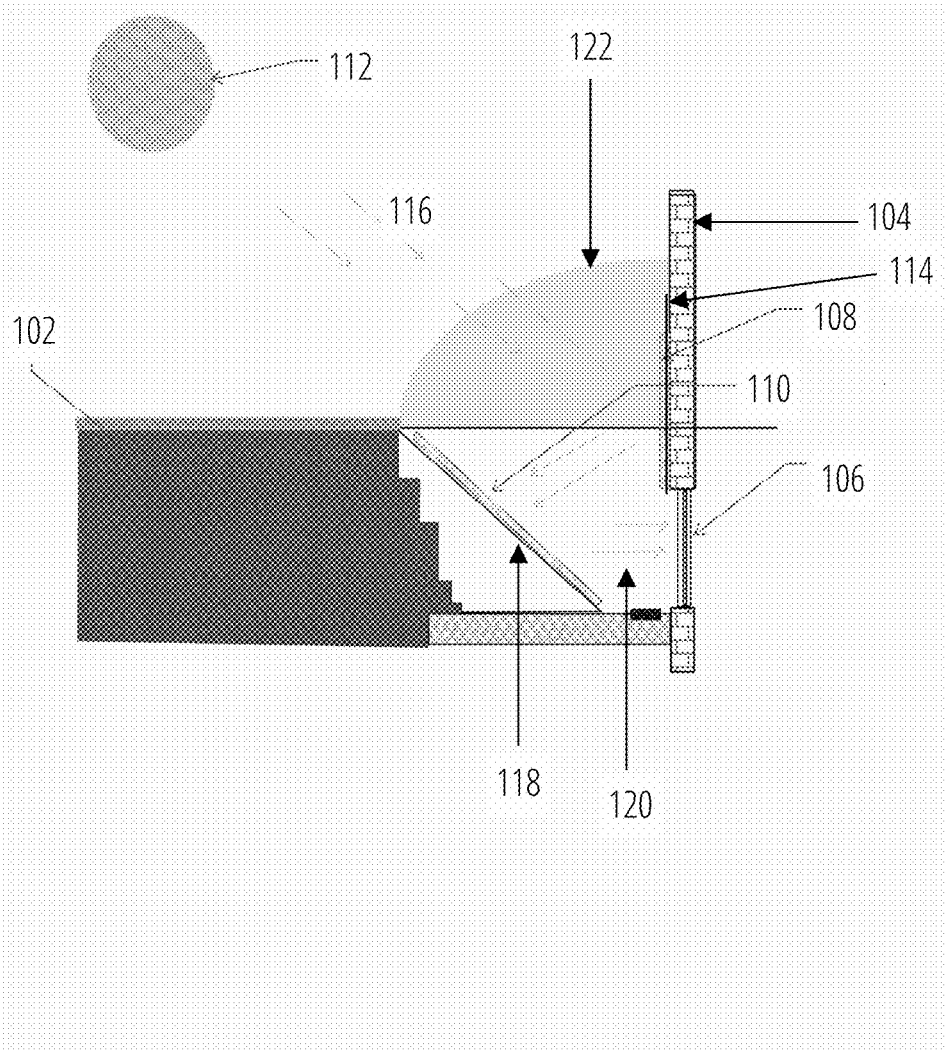
FIG. 1 illustrates a cross sectional side view of an aspect of the subject matter in accordance with one embodiment of the invention.

FIG. 1 shows a cross sectional view of a window well installation in accordance with an embodiment of the invention. A window 106 is shown installed on the side of a wall 104 in a subterranean location. A known corrugated window well panel (not shown) is installed in the ground 102, defining a window well void 120 that is enclosed by a cover 122.

One or more window facing reflective panels 110 or surfaces are mounted within the window well void 120 on a window well mounted reflective panel support 118. A wall mounted reflective panel 108 is affixed to the wall 104 by a wall mount 114. The wall mount 114 may be angled such that sunlight 116 from the sun 112 is reflected from the surface of the wall mounted reflective panel 108 onto the window facing reflective panels 110. Sunlight is then reflected off the surface of the window facing reflective panels 110 through the window 106 into the basement of the building.

Referring generally to the embodiment of the invention illustrated in FIG. 1, an embodiment of the window well cover 122 of the present invention is disclosed. The window well cover 122 includes a cover portion that is designed to fit over a window well of a building and against the adjacent exterior wall of that building. The cover portion is made from a durable material, such as plastics, metals, polymer, composite, or other durable material, to prevent snow water and other elements from penetrating there in there through. Further, this material may be resistant to various temperature changes and various environmental conditions such as subfreezing temperatures, snowstorms, rainstorms and other type of environmental events. The durability of the material reduces the risk of the cover portion cracking, breaking or otherwise structurally failing.

In certain embodiments of the invention, the window well cover 122 apparatus also includes a plurality of reflective panels that are configured to direct sunlight into the basement window upon which the cover portion is positioned above. The reflective panels may include a first panel being affixed to the exterior wall of the building up in a position above the basement window. This reflective panel may extend into the window well and it may be located completely below the cover portion.

The reflective panel located within the window well opposite the basement window includes two reflective panels. This is illustrative and not meant to be limiting. Those skilled in the art will recognize that a plurality of reflective panels may be utilized and would be within the scope of the present invention.

In operation, sunlight may penetrate through the cover portion striking the first reflective panel. The first reflective panel is configured such that it will reflect the sunlight in a direction toward the second reflective panel. The second reflective panel will receive the reflected sunlight from the first reflective panel and redirect that light toward the basement window. Since the sunlight that would strike the first reflective panel would normally be sunlight striking the exterior of the building and not sunlight that not reach the basement window, the redirection of that sunlight, by the plurality of reflective panels, would allow for that light to be directed into the basement. This allows for more natural light to enter the basement.

Figure 2:
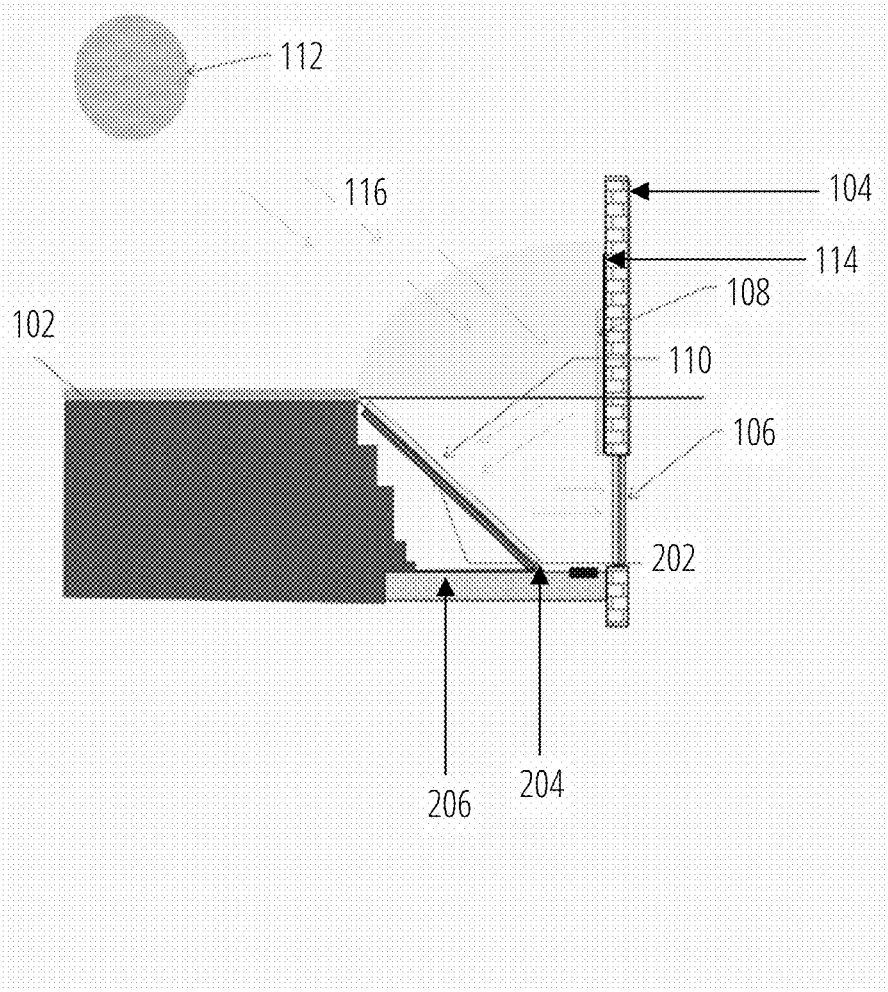
FIG. 2 illustrates a cross sectional side view of an aspect of the subject matter in accordance with one embodiment of the invention in a pre-deployment condition.

FIG. 2 shows a cross sectional view of a window well installation in accordance with an embodiment of the invention. In addition to the elements as described in FIG. 1, a flood prevention apparatus is also indicated.

The window facing reflective panels 110 are installed on an upper surface of a window facing reflective panel supporting member 204. The window facing reflective panel supporting member 204 may be attached to the known corrugated window well panel (not shown) and may rest on the base of window well 206. In the illustrated embodiment of the invention, the flood protection device 202 is mounted to the lower surface of the window facing reflective panel supporting member 204.

Referring generally to FIG. 2, this embodiment is directed toward the prevention of water from entering the basement through the window well. In this embodiment, the window well cover is similar to the embodiment illustrated in FIG. 1 in that it includes a cover portion that is designed to fit over a window well of a building and against the adjacent exterior wall of that building and a plurality of reflective panels that are configured to direct sunlight into the basement window upon which the cover portion is positioned above. The reflective panels may include a first panel being affixed to the exterior wall of the building up in a position above the basement window. This reflective panel may extend into the window well and it may be located completely below the cover portion.

Again, a reflective panel may be located within the window well opposite the basement window. This embodiment includes two reflective panels. This is illustrative and not meant to be limiting. Those skilled in the art will recognize that a plurality of reflective panels may be utilized and would be within the scope of the present invention.

This illustrative embodiment features a flood protection device 202 in its non-deployed configuration. For example, a container of a flood/water proof material is positioned next to at least one of the reflective panels that is located within the window well. The container may be attached directly to the reflective panel, as shown in FIG. 2, or it may be separately located (not shown). The flood/water proof material is configured to expand to fill substantially all the space within the window well in order to prevent water from entering therein. The material may be any material that is configured to resist water from penetrating therein and therethrough. Such material may be a waterproof foam, a plastic based bladder or other similar type of material.

The container may have a water saturation device, e.g. water gauge, sensor, etc, to determine the amount of water that is entering into the window well, of a separate sensor may be employed. This device may be utilized to determine when the container may open. This can prevent the premature, or otherwise unnecessary, opening of the container. In operation, when moisture enters into the window well, the container, upon activation, will open or otherwise release the flood/water proof material. The material will then expand to fill the window well space and thus preventing water from entering therein. This will have the effect of stopping substantially all water from entering the basement through the window well.

Figure 3:
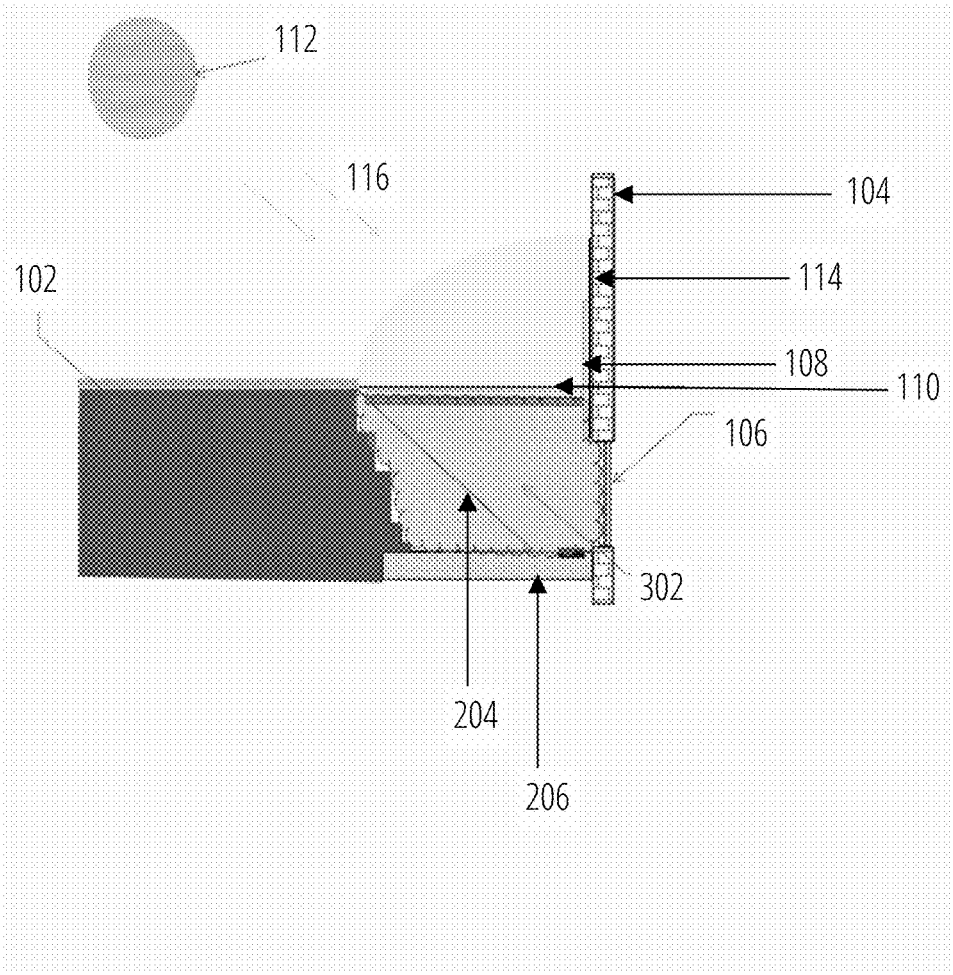
FIG. 3 illustrates a cross sectional side view of an aspect of the subject matter in accordance with one embodiment of the invention in a pre-deployment condition.

FIG. 3 shows a cross sectional view of a window well installation in accordance with an embodiment of the invention. In addition to the elements as described in FIG. 1 and FIG. 2, a deployed flood prevention device 302 is also indicated.

In the embodiment as illustrated, the deployed flood prevention device 302 has expanded beneath the window well mounted reflective panel support 118 resulting in the window well mounted reflective panel support 118 and the window facing reflective panels 110 that are mounted thereon being lifted from their non-deployed position.

The deployed flood prevention device 302 can be seen to expand to fill the window well void 120 and protect the window 106 from imploding into the basement under the extreme pressure caused by exterior flooding.

Figure 4:
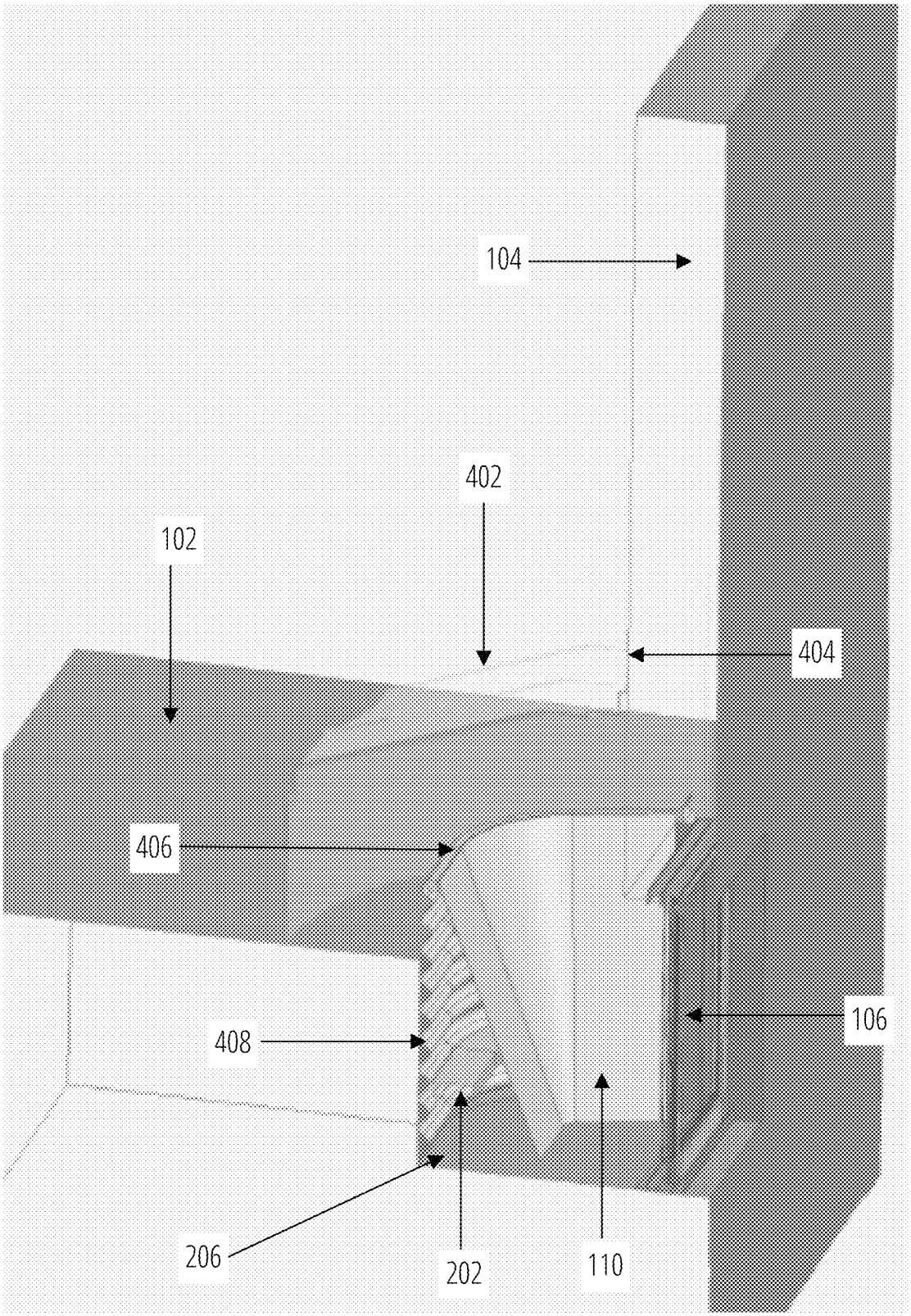
FIG. 4 illustrates a sectional view of an aspect of the subject matter in accordance with one embodiment of the invention.

FIG. 4 shows a cross sectional view in perspective, indicating the relative positioning of the inventive features of the window well installation in relation to a standard pre-fitted corrugated egress window well 408. It can be seen that in the illustrated embodiment of the invention that the window facing reflective panel supporting member 204 is affixed to the top of the corrugated egress window well 408 via a window facing reflective panel support attachment member 406.

In the illustrated embodiment, the window well cover 402 can be seen to totally encompass the corrugated egress window well 408. In alternative embodiments, the window well cover 402 can affix to the top of the corrugated egress window well 408. In either of these embodiments, the window well cover 402 may optionally be fixed to the wall 104 by way of a cover attachment member 404 using fasteners known to those of skill in the field.

In this embodiment, the flood protection device 202 can be seen affixed to the corrugated egress window well 408. When deployed, the flood protection device 202 may expand around the window facing reflective panel supporting member 204 to fill the window well void 120, or it may displace the window facing reflective panel supporting member 204 and window facing reflective panels 110.

Figure 5:
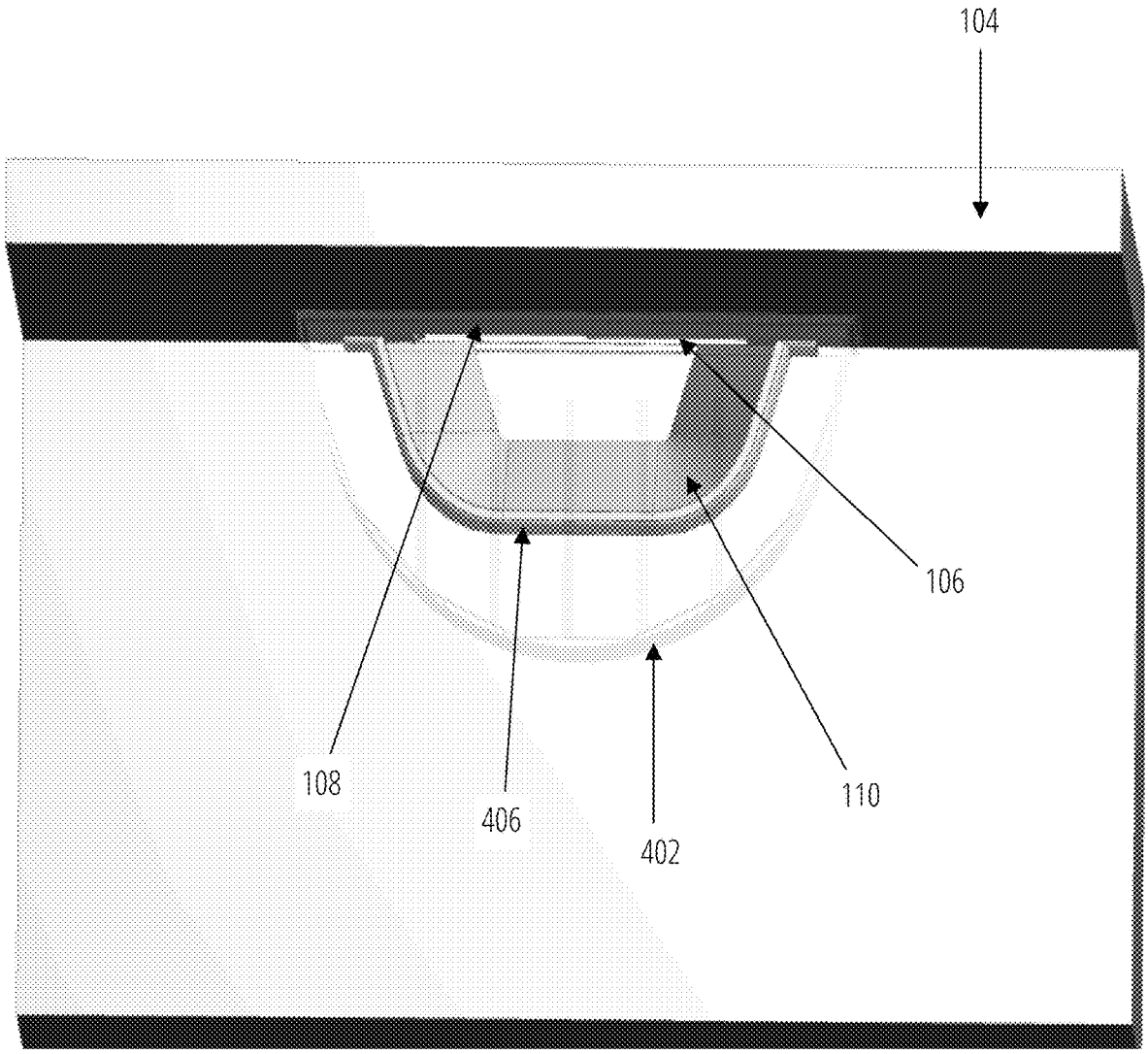
FIG. 5 illustrates a top view of an aspect of the subject matter in accordance with one embodiment of the invention.

FIG. 5 shows a top view of an embodiment of the invention. The relative positioning of the window well cover 402 can be seen encompassing the corrugated egress window well 408. In the embodiment as shown, the window well cover 402 is significantly larger than the corrugated egress window well 408. In other embodiments (not shown) both the window well cover 402 and the corrugated egress window well 408 are similarly dimensioned. In the latter embodiment, the window well cover 402 may be removably affixed to the corrugated egress window well 408.

Figure 6:
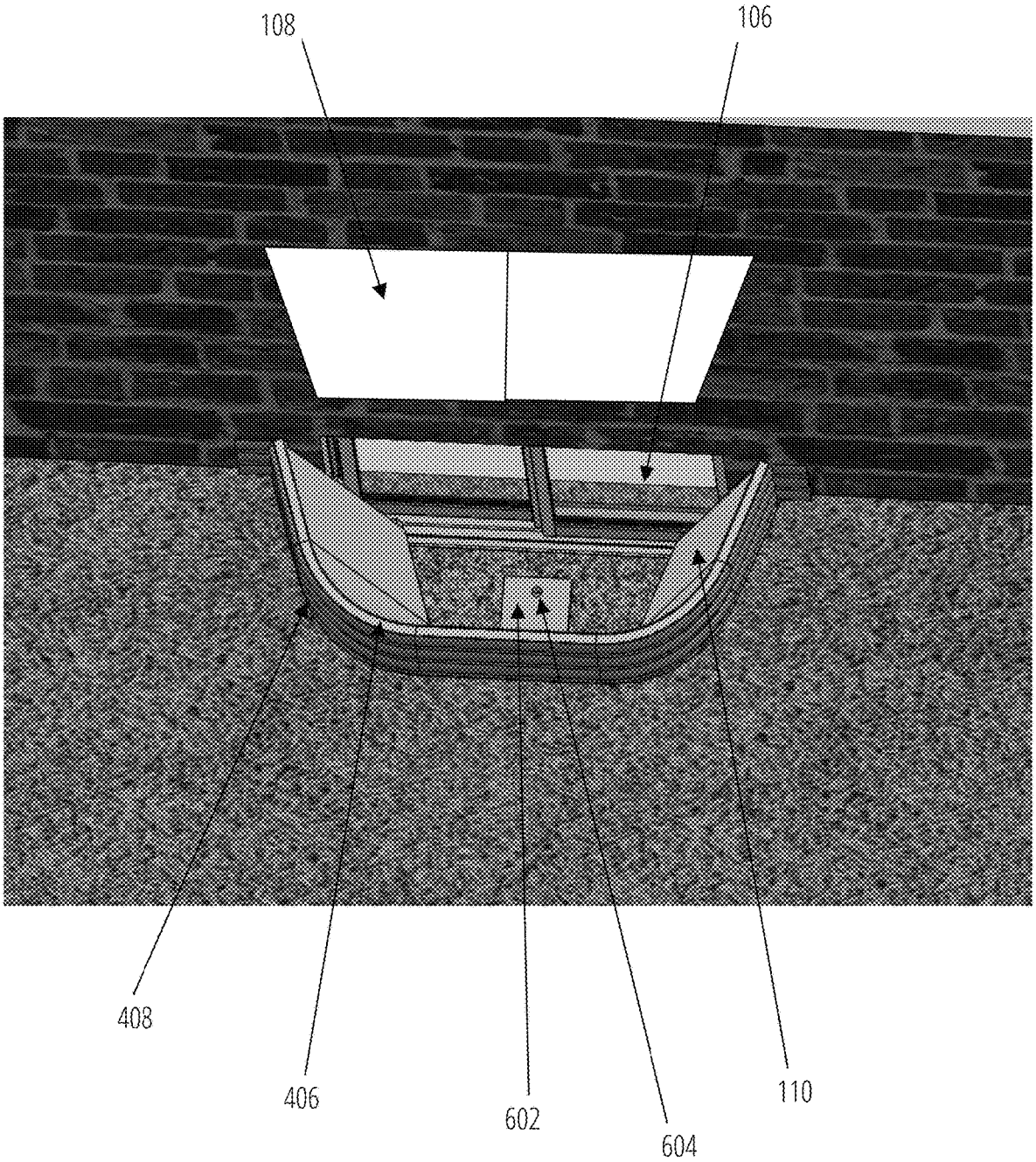
FIG. 6 illustrates a top perspective view of an aspect of the subject matter in accordance with one embodiment of the invention.

FIG. 6 shows a top view of an embodiment of the invention in perspective. The window facing reflective panel support attachment member 406 can clearly be seen attaching the window facing reflective panel supporting member 204 and window facing reflective panels 110 to the upper edge of the corrugated egress window well 408.

The wall mounted reflective panel 108 has been positioned and angled on the wall, typically by means of a wall mount 114, such that sunlight 116 that is incident on the wall mounted reflective panel 108 is reflected onto the window facing reflective panels 110 and then into the basement via the window 106.

The housing 602 may serve dual functions. It can be anchored to the base of window well 206 and thereby used to fix the angle at which the window facing reflective panels 110 is sloped. This can be achieved by either fixing or resting the base of the window facing reflective panel supporting member 204 against a side of the housing 602 and then positioning the housing 602 such that the surface of the window facing reflective panels 110 are at the appropriate angle to direct the light incident from the wall mounted reflective panel 108 through the window 106. The second function of the housing 602 is to accommodate a drain containing water sensor 604 in embodiments of the invention having the flood protection modality.

Figure 7:
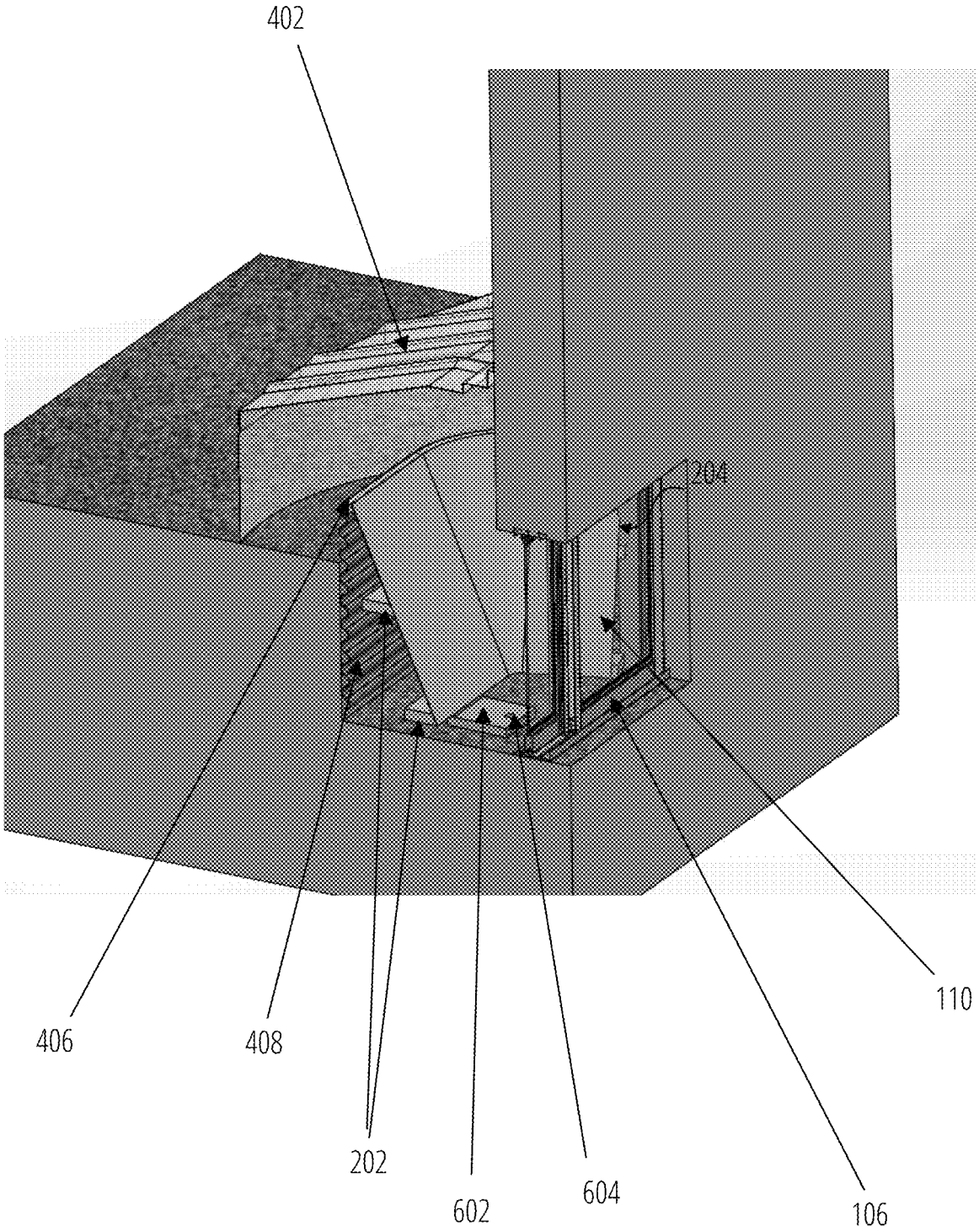
FIG. 7 illustrates a side sectional view of an aspect of the subject matter in accordance with one embodiment of the invention.

FIG. 7 shows a sectional view of an embodiment of the invention in perspective. In this particular embodiment, a flood protection device 202 is mounted at the base of the window well mounted reflective panel support 118 and a second flood protection device 202 is mounted at an approximate mid-point on the window well mounted reflective panel support 118.

In this embodiment the housing 602 comprising a drain containing water sensor 604 is positioned at the base of window well 206, anchoring the window facing reflective panel supporting members 204 in place. When the sensor, located in the drain containing water sensor 604 detects a level of accumulated water at the base of window well 206 then the flood protection device 202 or devices are activated.

Figure 8:
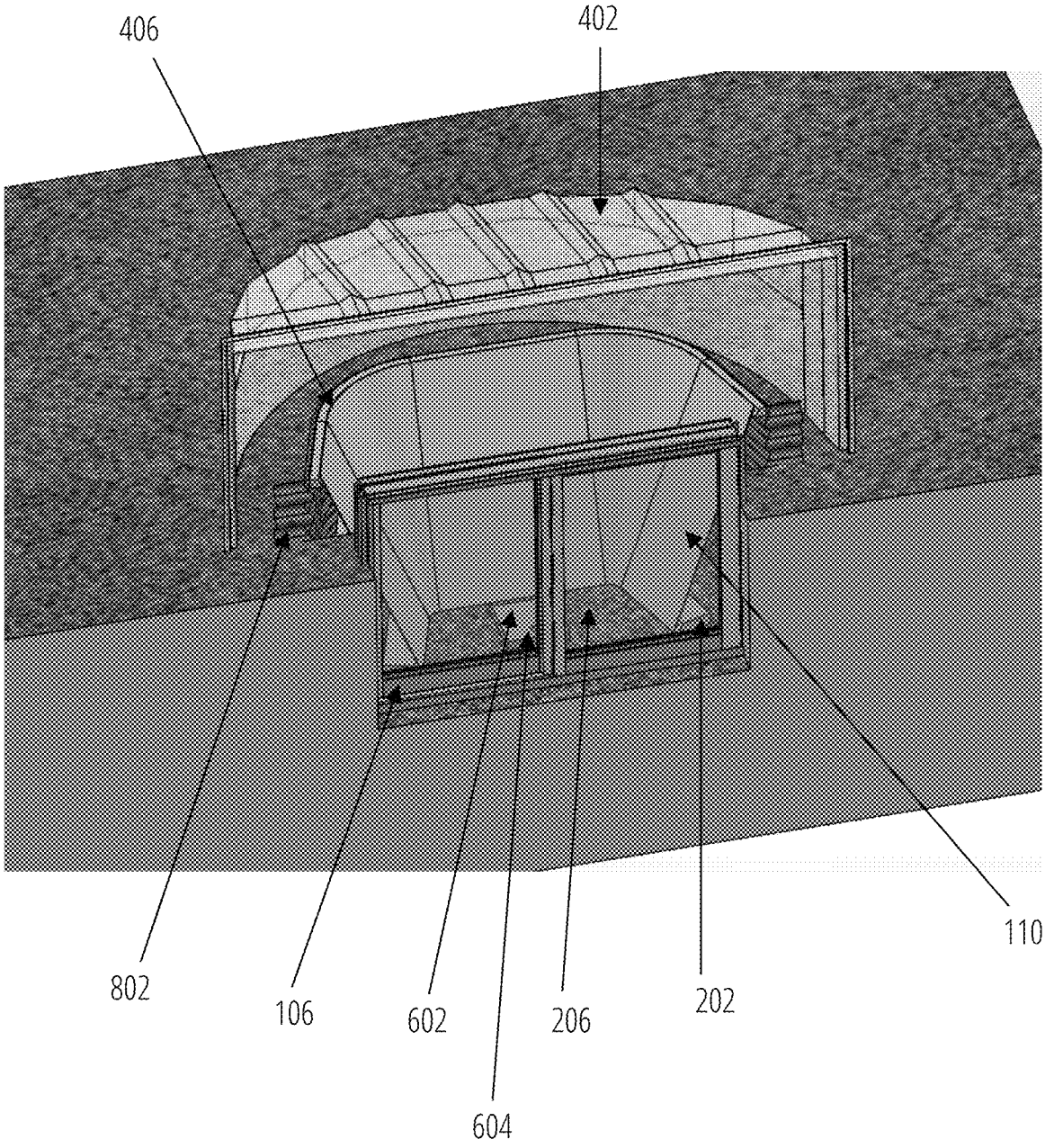
FIG. 8 illustrates a rear sectional view of an aspect of the subject matter in accordance with one embodiment of the invention.

FIG. 8 shows a rear perspective view of an embodiment of the invention. The relative positioning of the respective parts of this embodiment can be seen. The corrugated egress window well 408 can be seen to be attached to the wall 104 by means of a wall attachment portion 802.

Figure 9:
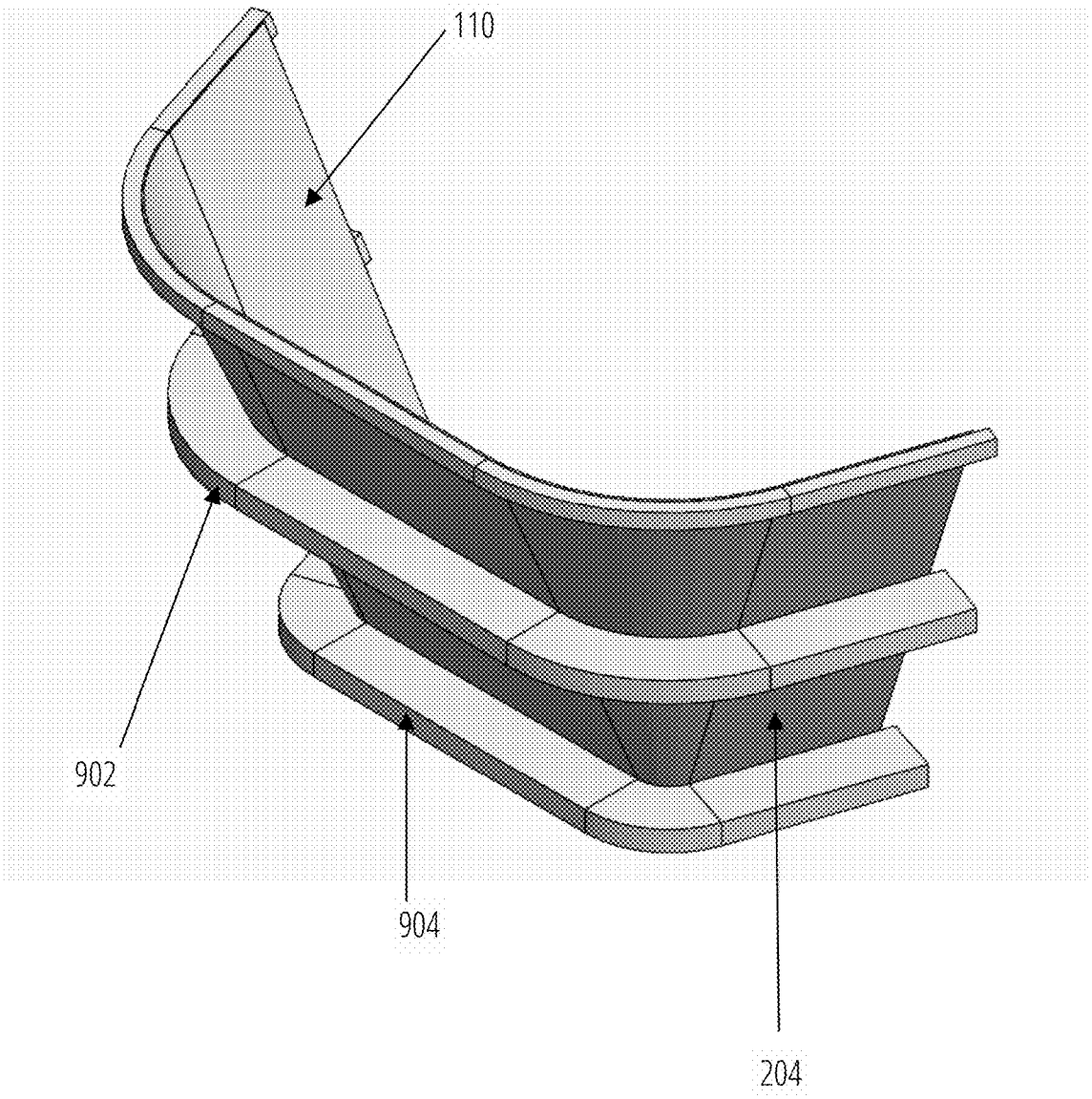
FIG. 9 illustrates a perspective view of an aspect of the subject matter in accordance with one embodiment of the invention.

FIG. 9 shows a more detailed perspective view of the window facing reflective panels 110. In the embodiment as illustrated, the window facing reflective panel supporting member 204 can clearly be seen supporting the window facing reflective panels 110.

In this embodiment a first flood protection device 902 can be seen in its non-deployed configuration centrally located on the window facing reflective panel supporting member 204. A second flood protection device 904 can also be seen located towards the base edge of the window facing reflective panel supporting member 204.

This embodiment further illustrates the window facing reflective panel supporting member 204, and the window facing reflective panels 110 and the flood protection device 202 (illustrated here as first flood protection device 902 and second flood protection device 904) can each be fabricated in multiple sections.

In embodiments of the invention that do not have the window facing reflective panels 110 within the window well void 120, then the flood protection devices 202 may be mounted directly onto an inner surface of the corrugated egress window well 408.

Figure 10:
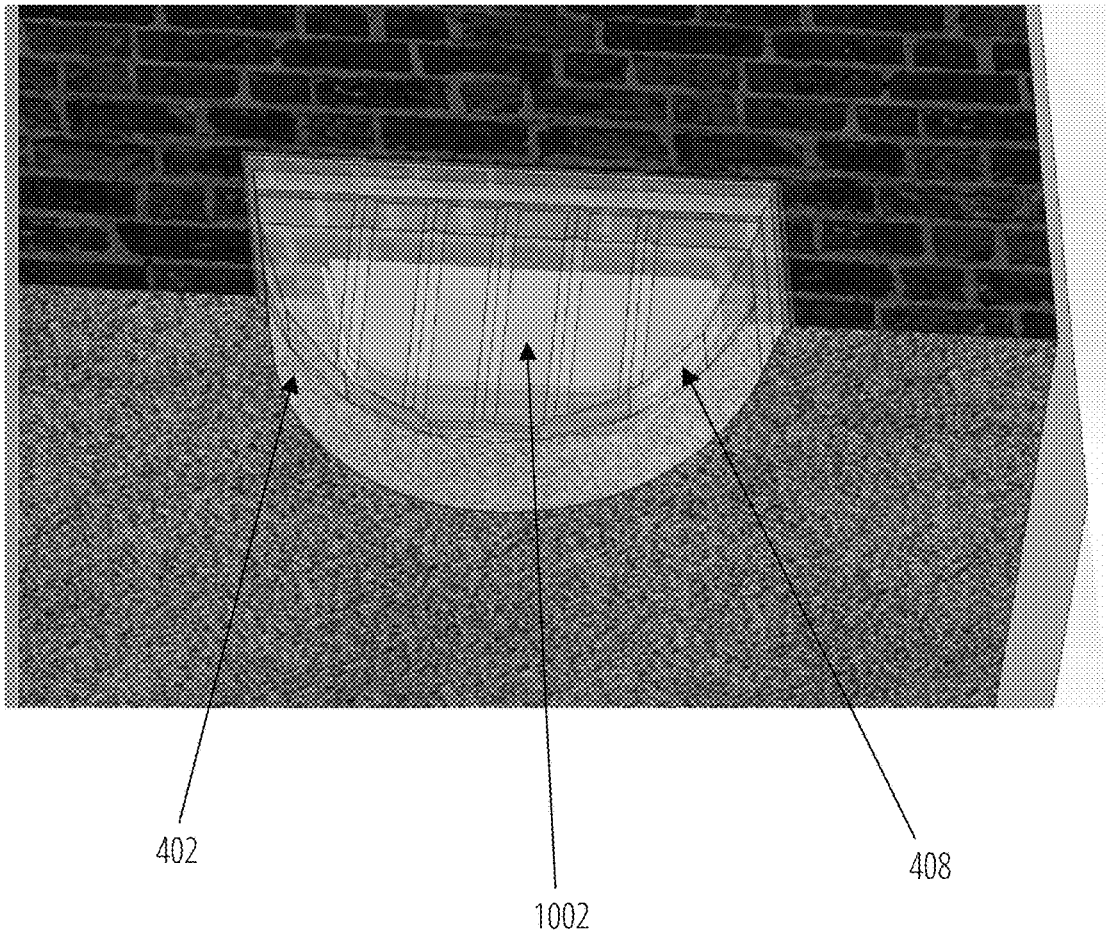
FIG. 10 illustrates a top perspective view of an aspect of the subject matter in accordance with one embodiment of the invention.

FIG. 10 shows a top perspective view of an embodiment of the invention. This figure illustrates a known corrugated egress window well 408 where in the window well void 120 (not shown) is completely filled with the activated flood protection device 1002.

Figure 11:
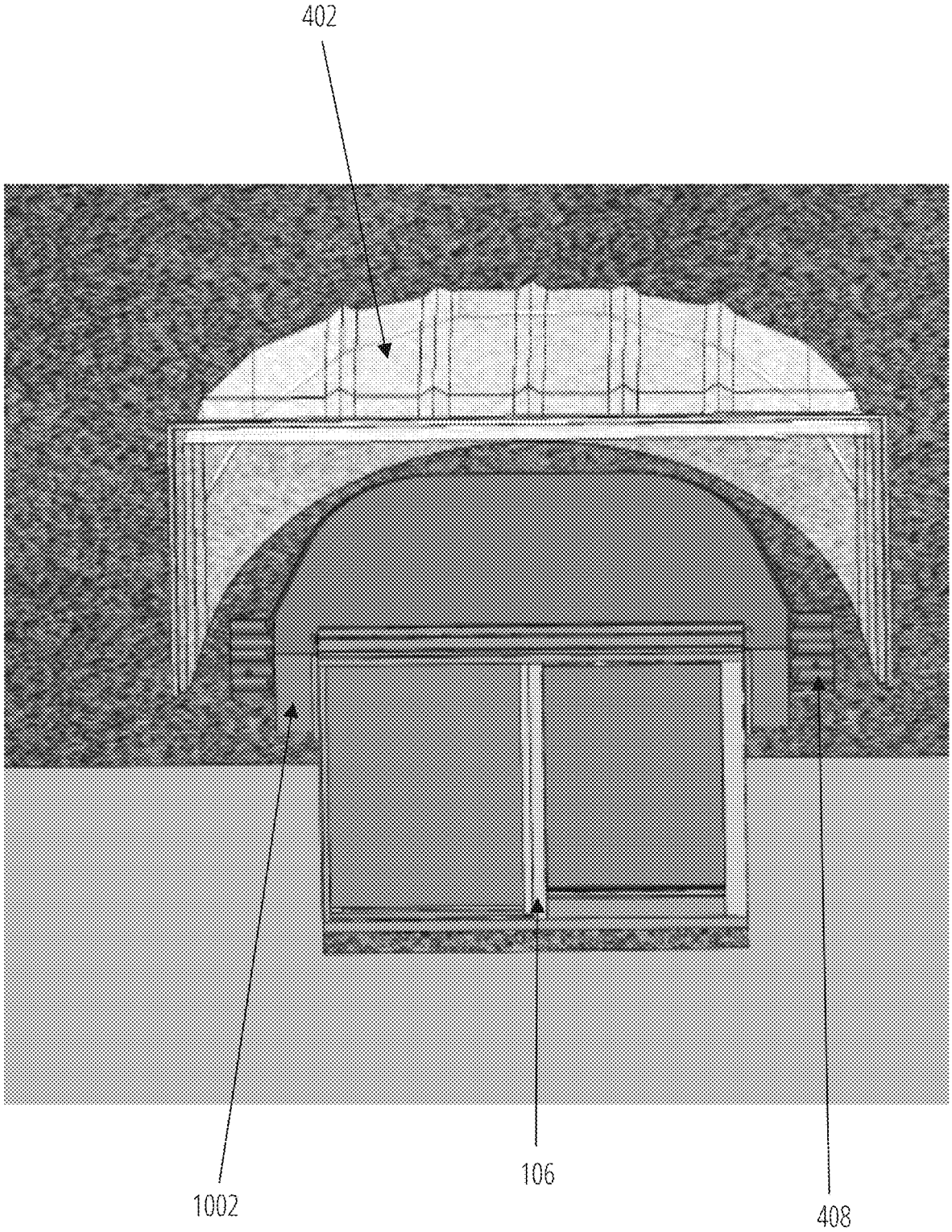
FIG. 11 illustrates a rear perspective view of an aspect of the subject matter in accordance with one embodiment of the invention.

FIG. 11 shows a rear view of an embodiment of the invention. This figure illustrates a known corrugated egress window well 408 where in the window well void 120 is completely filled with the activated flood protection device 1002. The activated flood protection device 1002 can clearly be seen to be protecting the window 106 from exterior flood water.

Figure 12:
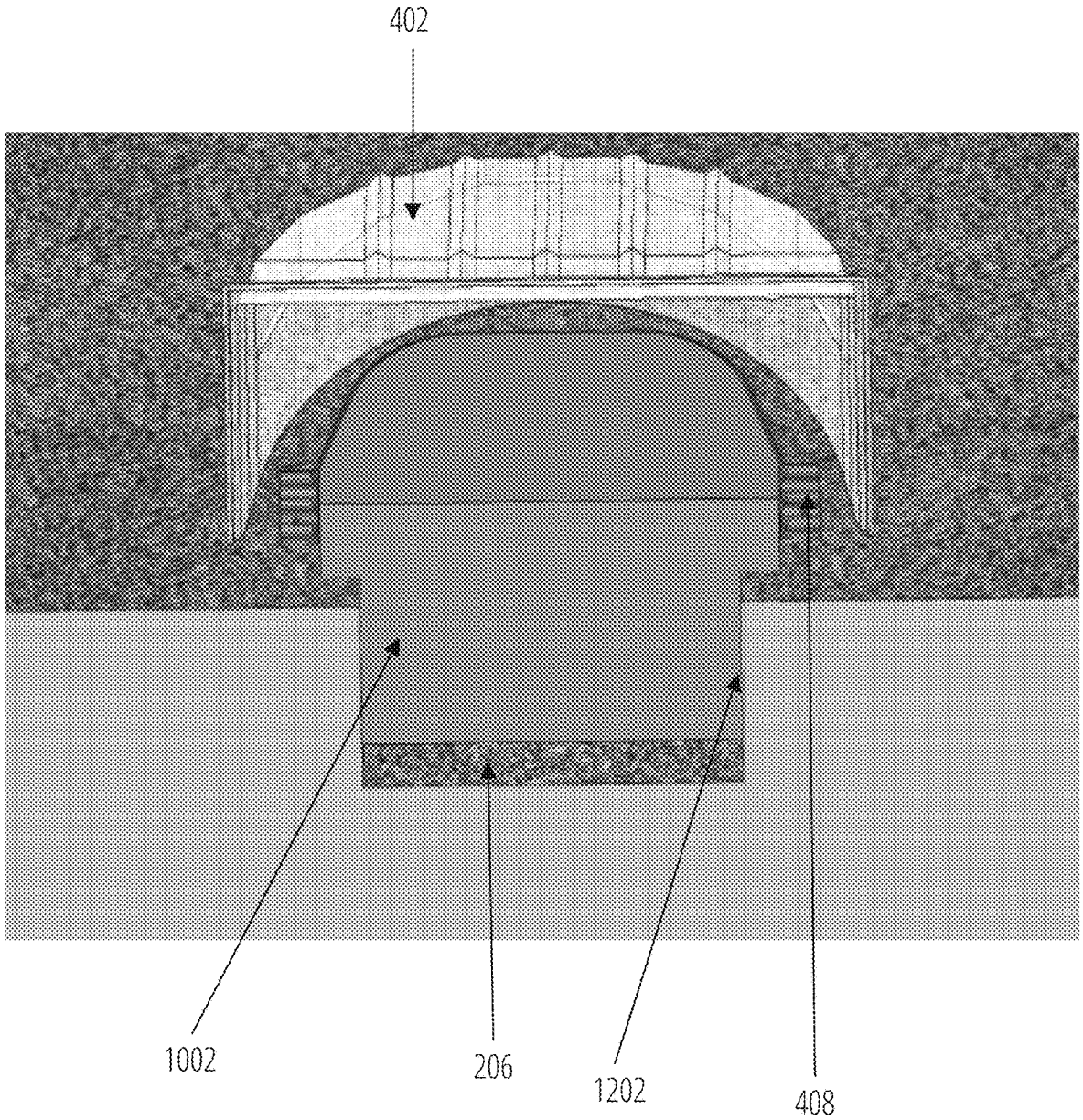
FIG. 12 illustrates a rear perspective view of an aspect of the subject matter in accordance with one embodiment of the invention.

FIG. 12 shows a rear view of an embodiment of the invention. This figure illustrates a known corrugated egress window well 408 where in the window well void 120 is completely filled with the activated flood protection device 1002. The activated flood protection device 1002 can clearly be seen to be protecting forming a sealed perimeter 1202 around the window 106 and along the wall 104 from exterior flood water.

Figure 13:
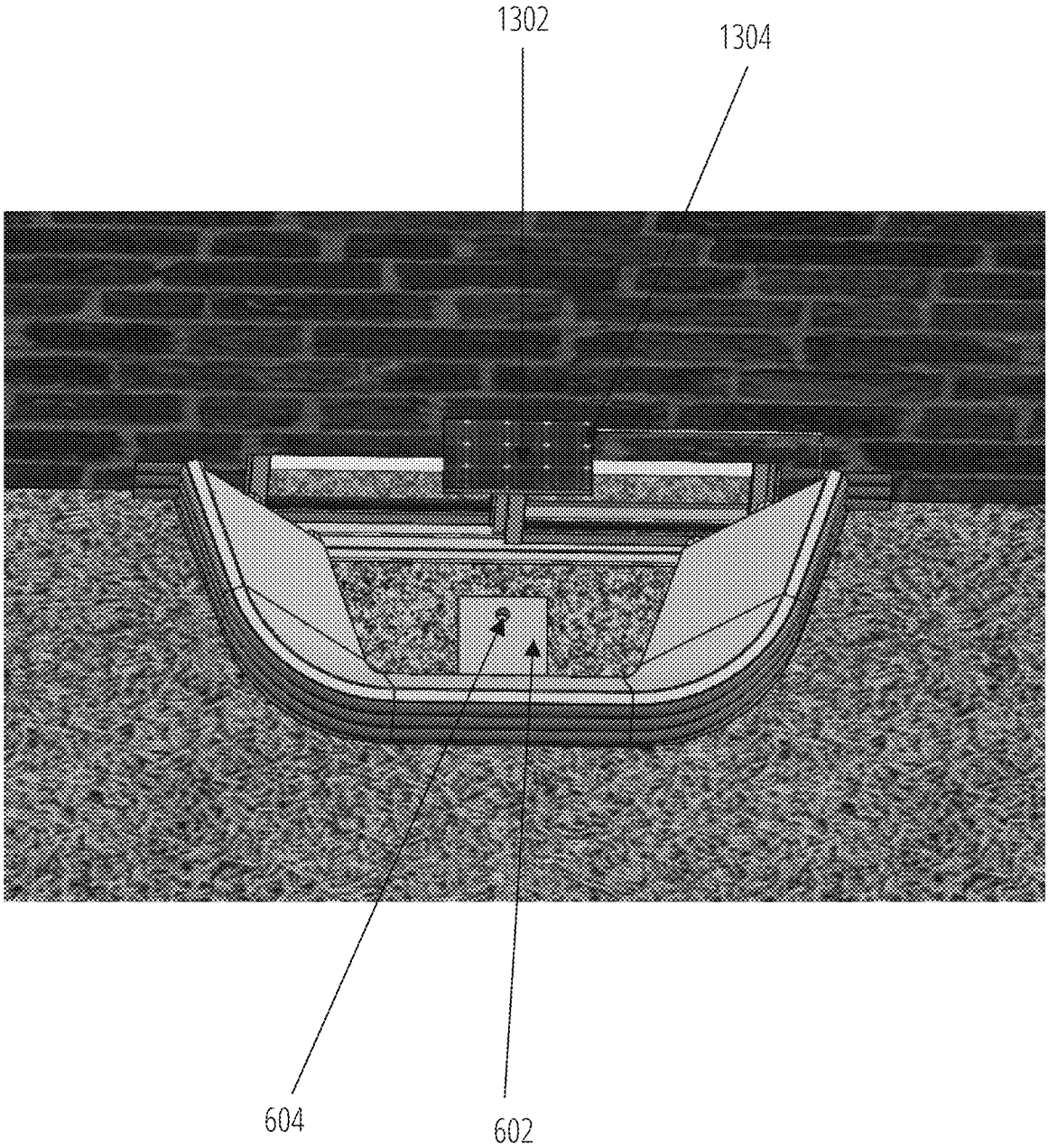
FIG. 13 illustrates a top perspective view of an aspect of the subject matter in accordance with one embodiment.

FIG. 13 shows a top down view of a housing 602 and drain containing water sensor 604, that is anchored in place at the base of window well 206, and is positioned so at to fix the window facing reflective panel supporting members 204 at the appropriate angle.

A solar device 1302 can be seen affixed to the wall 104 above the window 106. The solar device 1302 powers the sensor contained within the drain containing water sensor 604 within the housing 602. The solar device 1302 may be mounted in various positions in close proximity to the window well. In the embodiment illustrated, the solar device 1302 also comprises one or more LED lights 1304 that can provide additional light to be reflected into the window 106.

Figure 14:
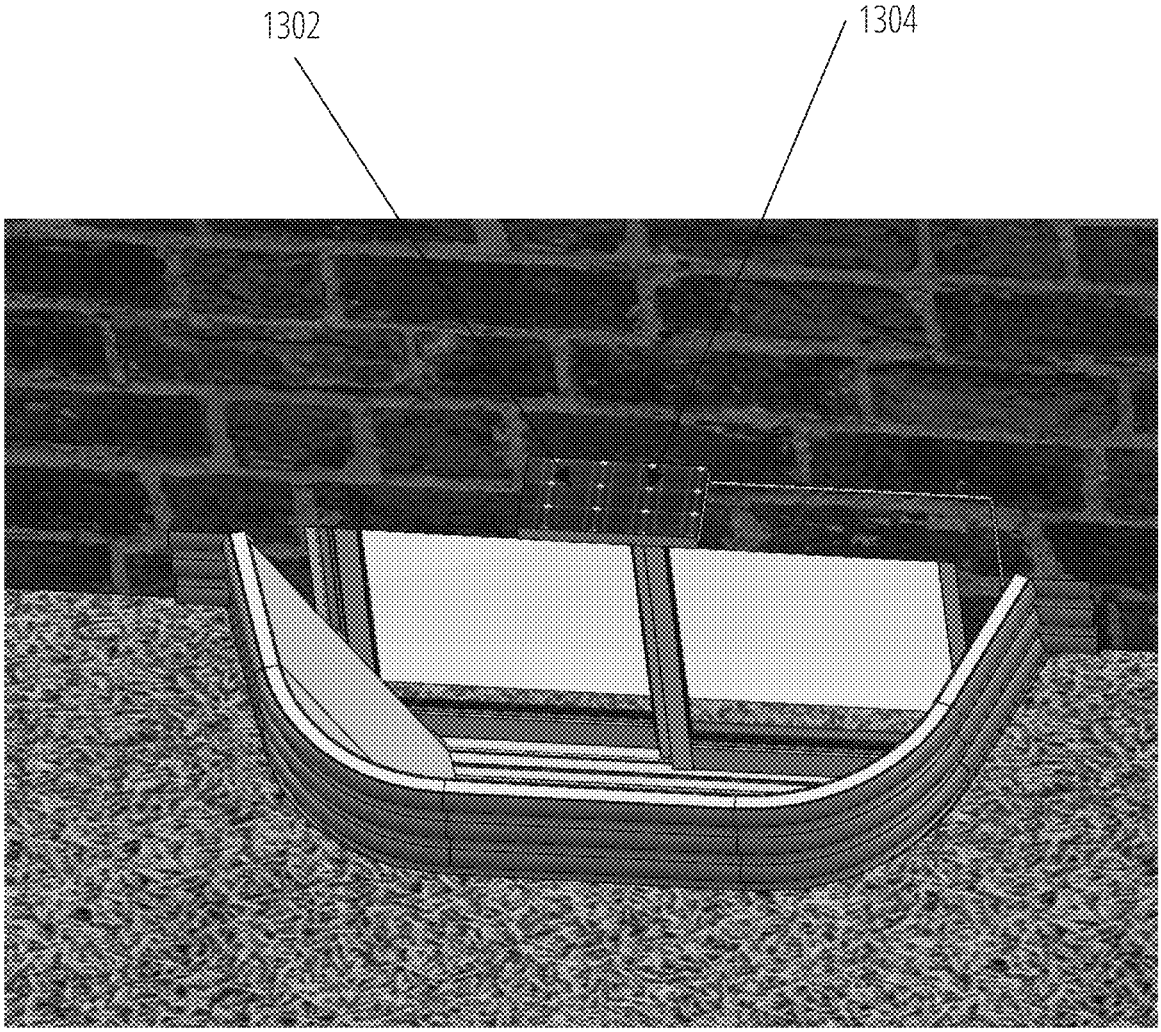
FIG. 14 illustrates a side perspective view an aspect of the subject matter in accordance with one embodiment.

FIG. 14 shows a perspective view of an embodiment of the invention indicating the relative positions of the solar device 1302 affixed to the wall 104 above the window 106. The solar device 1302 powers the sensor (not shown) in the drain containing water sensor 604 within the housing 602. The solar device 1302 is mounted above the window 106 such that the one or more LED lights 1304 that can provide additional light to be reflected into the window 106.

Figure 15:
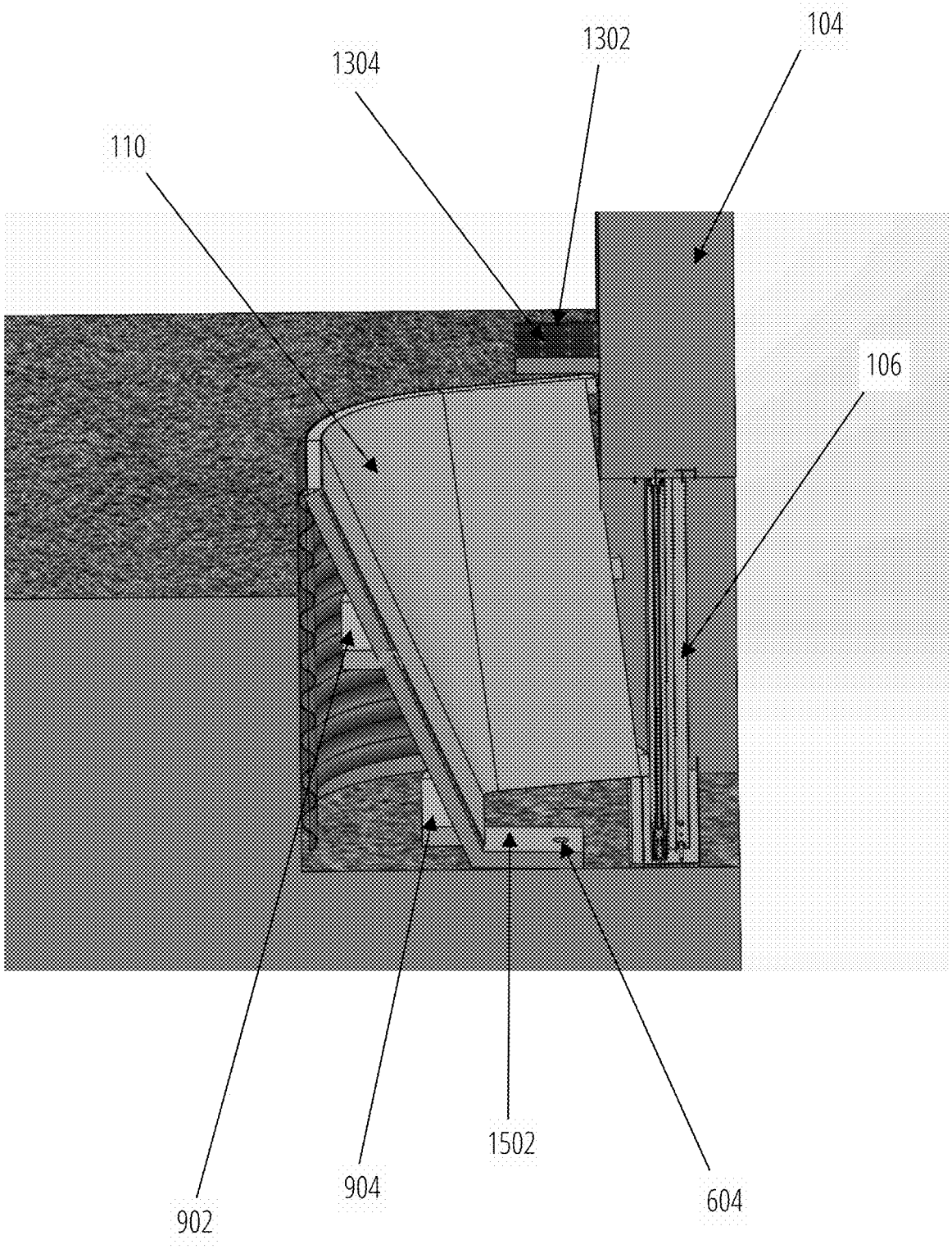
FIG. 15 illustrates a cross sectional view of an aspect of the subject matter in accordance with one embodiment.

FIG. 15 shows a cross sectional side view of an embodiment of the invention. The solar device 1302 containing one or more LED lights 1304 can be seen positioned over the wall 104 mounted window 106.

In this particular embodiment the drain containing water sensor 604 can be seen embedded in a unitary drain/sensor housing and reflective panel support 1502.

In this particular embodiment the flood protection devices 202 are also mounted on the unitary drain/sensor housing and reflective panel support 1502.

Figure 16:
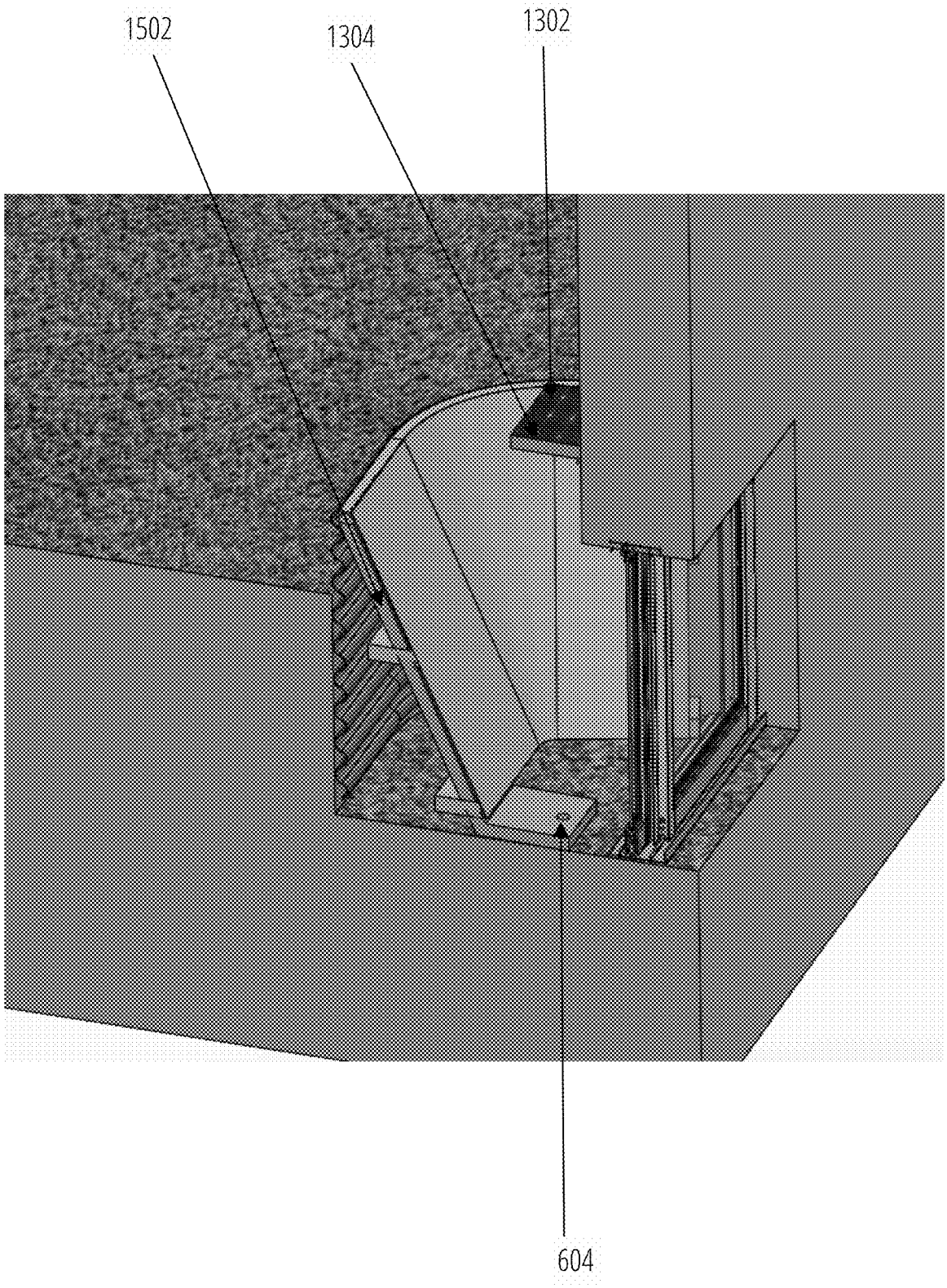
FIG. 16 illustrates a cross sectional perspective view of an aspect of the subject matter in accordance with one embodiment.

FIG. 16 shows a cross sectional perspective view of the embodiment of the invention illustrated in FIG. 15.

In other embodiments, one or more of the reflective panels may be concave to maximize and focus light deflection into the basement window 106 or onto the window facing reflective panels 110.

In other embodiments, the window well cover may contain concave sections to maximize the light deflection into the basement window 106 or onto the window facing reflective panels 110.

The window facing reflective panels 110 may be fabricated from a rigid or flexible conformable material. Typically, in the embodiments of the invention that also have the flood protection devices 202 situated within the window well voids 120, the window facing reflective panels 110 are made from a flexible material. When the flood protection devices 202 are activated, the window facing reflective panels 110 are either pushed up to the surface of the ground 102 or against the window 106 for additional flood protection. In embodiments of the invention that do not have a flood protection device 202 in the window well void 120 then the window facing reflective panels 110 may be fabricated from a more rigid material.

Typically, the water sensor in the drain containing water sensor 604 detects how much water is collecting in the well and sends a signal to a mobile device/app or alarm system. The flood protection devices 202 can be activated remotely from a mobile device or by using a remote control.

When the flood protection devices 202 have been remotely or manually activated they will expand to fill the window well void 120. It is contemplated that the flood protection devices 202 may comprise: foam core; foil; fabric; a durable plastic; or an air-bag type device. In some instances, the flood protection devices 202 may require electrical activation, and this may be provided via the solar devices 1302.

In summary, the window well installation described herein is engineered with the purpose of directing natural sunlight into the basement or other below-ground facilities through a window or other transparent partitions by utilizing a unique assembly constructed using structured free-form reflective material and other components. The available safety and comfort add-on options include, but are not limited to expendable flood-prevention mechanism and plastic well cover to prevent downward water penetration.

The benefits of the structured free-form reflective material include: directing natural sunlight into the basement with the intent of illuminating the space and reducing or eliminating the need to use fluorescent lighting during the day; engineered structure supports the free-form reflective material to collect and direct sunrays into the basement through a window, which significantly increases the level of brightness and fills the space with natural sunlight; enhancement in aesthetics and functionality of the living environment; improved sleep and other health benefits for the occupants; mood lifting benefits such as brain's release of serotonin, which help occupants feel calm and focused (low serotonin is associated with risk of depression); reduced stress levels, lethargy, dizziness, nausea, eye strain, impaired vision, lightheadedness and other health-related physical and emotional symptoms associated with prolonged exposure to fluorescent lighting; environmental and cost-saving benefits for electricity consumption.

The benefits of the expandable flood-prevention mechanism add-on safety feature include: prevention of damage of the occupied environment due to flooding over the window well, through the window and into the basement; increased drainage; engineered construction and sensitivity of the expandable material prevents damage to the window when activated; the expandable mechanism is activated by a sensor that detects water levels and can be activated manually or remotely using a compatible device; safety of the occupants inside during extreme weather conditions; not limited to water damage, the flood prevention device can be manually deployed during high winds and other extremities; eliminating and/or reducing insurance claims as a result of flooding or other extremities.

The benefits of the plastic well cover mechanism add-on safety feature include: prevention of downward water penetration that can pool and cause flooding; durable long-lasting material that withstands temperature changes; prevents wet leaves, dirt and other debris from clogging the gravel and obstructing drainage; aids with regular maintenance compliance as required by Insurance Firms in order to validate claims (lack of regular window well maintenance may void insurance claims); prevents snow from piling inside the window well and obstructing light from coming into the basement; added level of protection from extremities other than rain, such as: strong winds, heavy snowfall, hail, falling icicles; added level of protection from rodents and other animals getting stuck inside the well; aesthetic benefits such as: keeping the windows cleaner longer, finished appearance and decorated look.

In certain embodiments of the invention, the structured free-form reflective material is draped over a supporting skeleton structure, or window well mounted reflective panel support 118, that holds the desired slope in order to optimize the natural sunlight and direct it into the basement through the window. The reflective material is clipped onto the steel window well along the top edge using a C-Channel or similar beam and/or mechanism. The free-form reflective material is malleable and can be adapted to varying height and sizes of the window well. The reflective material structure can be used in conjunction with flood-preventing expandable add-on safety mechanism and/or plastic well cover, or on its own.

The supporting skeletal structure, or window well mounted reflective panel support 118, can be adjusted to accommodate the height of the window well.

In embodiments of the invention featuring the expandable flood-prevention mechanism add-on safety feature: the supporting skeletal structure can be adjusted to accommodate the height of the window well; a sensor is integrated into the skeletal structure, or within a housing 602, to detect the level of water that is collected inside the window well; the sensor sends a signal to the occupant when water level reaches an alarming amount; the occupant can opt to manually engage the expandable mechanism from inside the house; if the occupant is not present inside the house during the event, they will also have the option of activating the mechanism remotely by using a compatible device.

The expandable flood-preventing add-on comes as a system and is connected to the skeletal structure. It is compacted, concealed and secured behind the skeletal structure and/or along the top edge of the steel window well. The expandable material remains compact until it is activated by the occupant. When occupant activates the mechanism, the compacted material expands and fills in the space inside the window well, thus preventing the water from flooding this space and the basement The plastic well cover mechanism add-on safety feature is constructed from durable long-lasting material that withstands temperature changes. It is typically transparent and transmits high percentage of natural sunlight. It is made from plastics, metals, polymer, composite or other durable material. It may be secured to the exterior wall of the building and sits on top of the soil.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A kit for enhancing sunlight entry into a basement window of a building, said basement window having a pre-installed corrugated egress window well defining a window well cavity, said kit comprising:

a reflective panel supporting structure sized and proportioned to fit within said window well cavity, said supporting structure having one or more reflective panel attachment members configured to attach to a top surface of said corrugated egress window well;

one or more first reflective panels sized and proportioned to fit within said window well cavity, each of said one or more reflective panels attached at an upper edge to one of said one or more attachment members and positioned to reflect said sunlight into said window; and said supporting structure or said one or more first reflective panels are adapted to support one or more flood protection devices, wherein said one or more flood protection devices, when deployed, expand to fill said window well cavity.

2. The kit of claim 1, further comprising a second reflective panel sized and proportioned to be affixed to an exterior wall of said building above said window.

3. The kit of claim 2, further comprising a mounting member for attaching said second reflective panel to said wall and positioning said second reflective panel at an angle to reflect sunlight onto said one or more first reflective panels.

4. The kit of claim 1, wherein said one or more flood protection devices are selected from the group comprising: foam core; foil; fabric; a durable plastic; or an air-bag type device, or combinations thereof.

5. The kit of claim 1, wherein said one or more flood protection devices are linked to one or more water detection sensors, said sensors, when activated, send a signal to a mobile device, application, or alarm system.

6. The kit of claim 5, further comprising a solar device configured to provide power to said one or more sensors.

7. The kit of claim 6, wherein said solar device also comprises one or more LED lights attached to said device.

8. The kit of claim 1, further comprising a window well cover sized and configured to fit over the window well, said cover having concave panels to focus and deflect incident light onto said one or more first reflective panels.

9. An apparatus for protecting a basement window of a building from flooding, said basement window having a pre-installed corrugated egress window well defining a window well cavity, said apparatus comprising:

one or more flood protection devices which, when deployed, expand to fill said window well cavity, said one or more flood protection devices configured to be affixed to said window well or any other supporting structure installed within and connected to an upper edge of said window well;

one or more water detection sensors that, when activated, sends a signal to a mobile device, application or alarm system; and a power source operationally engaged with said sensor.

10. The apparatus of claim 9, wherein said mobile device, application or alarm system receives said signal indicating that said one or more water detection sensors have been activated, said mobile device, application or alarm system sends a signal to said one or more flood protection devices resulting in activation of said one or more flood protection devices.

11. The apparatus of claim 9, wherein said one or more flood protection devices are selected from the group comprising: foam core; foil; fabric; a durable plastic; or an air-bag type device, or combinations thereof.

12. The apparatus of claim 9, wherein said power source is a solar device.

13. The apparatus of claim 9, wherein said other supporting structure additionally supports one or more light reflective panels, said light reflective panels being positioned to reflect light from one or more wall mounted reflective panels through said basement window.

14. A method of enhancing sunlight entry into a basement window of a building, said basement window having a pre-installed corrugated egress window well defining a window well cavity, said method comprising:

inserting a reflective panel supporting structure sized and proportioned to fit within said window well cavity, said supporting structure having one or more reflective panel attachment members configured to attach to a top surface of said corrugated egress window well;

installing and positioning one or more first reflective panels, sized and proportioned to fit within said window well cavity, to each of said one or more reflective panel attachment members;

adjusting the positioning of said one or more first light reflective panels to direct the sunlight incident on said one or more first light reflective panels through said window; and installing one or more flood protection devices within said window well, said one or more flood protection devices, which when deployed expand to fill said window well cavity, said one or more flood protection devices attached to said supporting structure or said corrugated egress window well.

15. The method of claim 14, wherein the installation of said one or more flood protection devices includes the step of installing one or more water sensor devices and a power supply device within said window well, which when activated, send a signal to a mobile device, application or alarm system.

16. The method of claim 15, wherein said mobile device, application or alarm system sends a signal to said one or more flood protection devices resulting in deployment of said one or more flood protection devices.

17. The kit of claim 1, wherein said one or more flood protection devices are attached to said supporting structure or to said one or more first reflective panels.

18. The method of claim 14, further comprising installing a second reflective panel on an exterior wall of said building above said window well, said panel being positioned at an angle to reflect the sunlight onto said one or more first reflective panels.

* * * * *